US008347500B2

(12) United States Patent
Durocher et al.

(10) Patent No.: US 8,347,500 B2
(45) Date of Patent: Jan. 8, 2013

(54) METHOD OF ASSEMBLY AND DISASSEMBLY OF A GAS TURBINE MID TURBINE FRAME

(75) Inventors: Eric Durocher, Vercheres (CA); John Pietrobon, Outremont (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1076 days.

(21) Appl. No.: 12/325,018

(22) Filed: Nov. 28, 2008

(65) Prior Publication Data

US 2010/0132373 A1 Jun. 3, 2010

(51) Int. Cl.
*B21K 25/00* (2006.01)

(52) U.S. Cl. ..... 29/889.2

(58) Field of Classification Search ..... 29/889.2
See application file for complete search history.

(56) References Cited

U.S. PATENT DOCUMENTS

| | | | |
|---|---|---|---|
| 2,616,662 | A | 11/1952 | Mierley |
| 2,620,157 | A | 12/1952 | Morley et al. |
| 2,639,579 | A | 5/1953 | Willgoos |
| 2,692,724 | A | 10/1954 | McLeod |
| 2,829,014 | A | 4/1958 | May |
| 2,869,941 | A | 1/1959 | Shoup, Jr. et al. |
| 2,919,888 | A | 1/1960 | Simmons |
| 2,928,648 | A | 3/1960 | Haines et al. |
| 2,941,781 | A | 6/1960 | Boyum |
| 3,084,849 | A | 4/1963 | Dennison |
| 3,261,587 | A | 7/1966 | Rowley |
| 3,312,448 | A | 4/1967 | Hull, Jr. et al. |
| 3,844,115 | A | 10/1974 | Freid |
| 4,245,951 | A | 1/1981 | Minnich |
| 4,304,522 | A | 12/1981 | Newland |
| 4,478,551 | A | 10/1984 | Honeycutt, Jr. et al. |
| 4,558,564 | A | 12/1985 | Bouiller et al. |
| 4,965,994 | A | 10/1990 | Ciokajlo et al. |
| 4,979,872 | A | 12/1990 | Myers et al. |
| 5,160,251 | A | 11/1992 | Ciokajlo |
| 5,307,622 | A | 5/1994 | Ciokajlo et al. |
| 5,361,580 | A | 11/1994 | Ciokajlo et al. |
| 5,438,756 | A | 8/1995 | Halchak et al. |
| 5,443,229 | A | 8/1995 | O'Brien et al. |
| 5,483,792 | A | 1/1996 | Czachor et al. |
| 5,564,897 | A | 10/1996 | Mansson |
| 5,634,767 | A | 6/1997 | Dawson |
| 5,746,574 | A | 5/1998 | Czachor et al. |
| 5,813,214 | A | 9/1998 | Moniz et al. |
| 6,185,925 | B1 | 2/2001 | Proctor et al. |
| 6,267,397 | B1 | 7/2001 | Hamada et al. |
| 6,438,837 | B1 | 8/2002 | Berry et al. |
| 6,619,030 | B1 | 9/2003 | Seda et al. |
| 6,669,442 | B2 | 12/2003 | Jinnai et al. |
| 6,708,482 | B2 | 3/2004 | Seda |
| 6,763,654 | B2 | 7/2004 | Orlando et al. |
| 6,793,458 | B2 | 9/2004 | Kawai et al. |
| 6,796,765 | B2 | 9/2004 | Kosel et al. |
| 6,883,303 | B1 | 4/2005 | Seda |
| 6,905,303 | B2 | 6/2005 | Liu et al. |
| 6,935,837 | B2 | 8/2005 | Moniz et al. |

(Continued)

*Primary Examiner* — David Bryant
*Assistant Examiner* — Moshe Wilensky
(74) *Attorney, Agent, or Firm* — Norton Rose Canada LLP

(57) ABSTRACT

A mid turbine frame with an annular interturbine duct may be assembled by placing an mid turbine frame inner case of into the interturbine duct, inserting a plurality of mid turbine frame spokes radially through respective hollow radial struts of the interturbine duct to be connected to the mid turbine frame inner case to form a mid turbine frame spoke casing. A mid turbine frame outer case is also connected to the spokes, to provide an assembled mid turbine frame.

18 Claims, 7 Drawing Sheets

U.S. PATENT DOCUMENTS

| | | | |
|---|---|---|---|
| 7,100,358 | B2 | 9/2006 | Gekht et al. |
| 7,195,447 | B2 | 3/2007 | Moniz et al. |
| 7,229,249 | B2 | 6/2007 | Durocher et al. |
| 7,269,938 | B2 | 9/2007 | Moniz et al. |
| 7,334,981 | B2 | 2/2008 | Moniz et al. |
| 7,341,429 | B2 | 3/2008 | Montgomery et al. |
| 2007/0044307 | A1 | 3/2007 | Bergerot et al. |
| 2007/0231134 | A1 | 10/2007 | Kumar et al. |
| 2007/0237635 | A1 | 10/2007 | Nagendra et al. |
| 2007/0261411 | A1 | 11/2007 | Nagendra et al. |
| 2007/0271923 | A1 | 11/2007 | Dawson |
| 2007/0292270 | A1 | 12/2007 | Suciu et al. |
| 2008/0022692 | A1 | 1/2008 | Nagendra et al. |
| 2008/0134687 | A1 | 6/2008 | Kumar et al. |
| 2008/0134688 | A1 | 6/2008 | Somanath et al. |

METHOD OF ASSEMBLY AND DISASSEMBLY OF A GAS TURBINE MID TURBINE FRAME

TECHNICAL FIELD

The application relates generally to gas turbine engines and more particularly, to a method of assembling a mid turbine frame thereof.

BACKGROUND OF THE ART

A gas turbine engine typically has at least a high pressure turbine stage and a low pressure turbine stage, and the gas path between the two is often referred to as an interturbine duct (ITD). The function of the ITD is to deliver combustion gases from the high to low turbine stage. Along the way, there is usually a stage of stationary airfoil vanes. In larger engines, ITDs are often incorporated into a frame configuration, such as a mid turbine frame (MTF), which transfers bearing loads from a main shaft supported by the frame to the engine outer case. Conventional ITDs are cast with structural vanes which guide combustion gases therethrough and transfer structural loads. It is a challenge in design to meet both aero and structural requirements, yet all the while providing a low cost, low weight design, to name but a few concerns, especially in aero applications. Accordingly, there is a need for improvement.

SUMMARY

According to one aspect, provided is a method for assembly of a gas turbine engine mid turbine frame (MTF) comprising the steps of: a) inserting an annular inner case within an annular interturbine duct (ITD), the ITD having at least three hollow struts radially extending between outer and inner duct walls, the struts cooperating with corresponding openings in the walls to provide radial passages through the ITD, the duct walls providing at least a portion of an engine gas path between turbine stages of the engine; b) inserting a load transfer spoke radially into each of the ITD hollow struts until one end of the spoke extends radially inwardly of the ITD inner duct wall and the other end extends radially outwardly of the ITD outer duct wall; c) connecting the inner end of the load transfer spoke each to the inner case; d) inserting the inner case, ITD and spokes within an outer case so that the outer case surrounds the outer ends of the spokes, the outer case configured for mounting to the engine to provide a portion of an outer casing of the engine; and e) connecting the outer end of the load transfer spokes to the outer case.

According to another aspect, provided is a method of assembly for a gas turbine engine mid turbine frame (MTF), the MTF having an annular inner case, and annular outer case, and at least three spokes extending therebetween, the method comprising the steps of: a) providing an annular interturbine duct (ITD), the duct having inner and outer duct walls and at least three hollow struts extending therebetween, the struts and duct walls cooperating to provide radial passageways through the ITD, the ITD configured to conduct combustion gases from an turbine exit toward a downstream turbine inlet; b) placing the inner case into the ITD and then inserting the spokes radially inwardly through the respective ITD hollow struts; and c) connecting the MTF inner case and the MTF outer case to the inner ends and outer ends, respectively, of the spokes.

According to a further aspect, provided is a method of disassembly for a gas turbine engine mid turbine frame (MTF), the MTF having annular inner and outer cases with radial spokes extending therebetween, the MTF further defining therethrough an annular interturbine duct (ITD) between the inner and outer MTF cases, the ITD having an inner and outer duct walls with hollow struts extending between the duct walls, the spokes disposed inside the hollow struts, the method comprising the steps of: a) removing a plurality of fasteners to disconnect the annular outer case of the MTF from a plurality of radial load transfer spokes of a spoke casing, and then removing the spoke casing from the annular outer case; b) removing a plurality of fasteners to disconnect the radial load transfer spokes from an inner case of the spoke casing; c) radially outwardly withdrawing the load transfer spokes from the annular ITD; and then d) removing the inner case of the spoke casing from the ITD.

Further details of these and other aspects of the present invention will be apparent from the following description.

DESCRIPTION OF THE DRAWINGS

Reference is now made to the accompanying drawings, in which.

DETAILED DESCRIPTION

Figure 1:
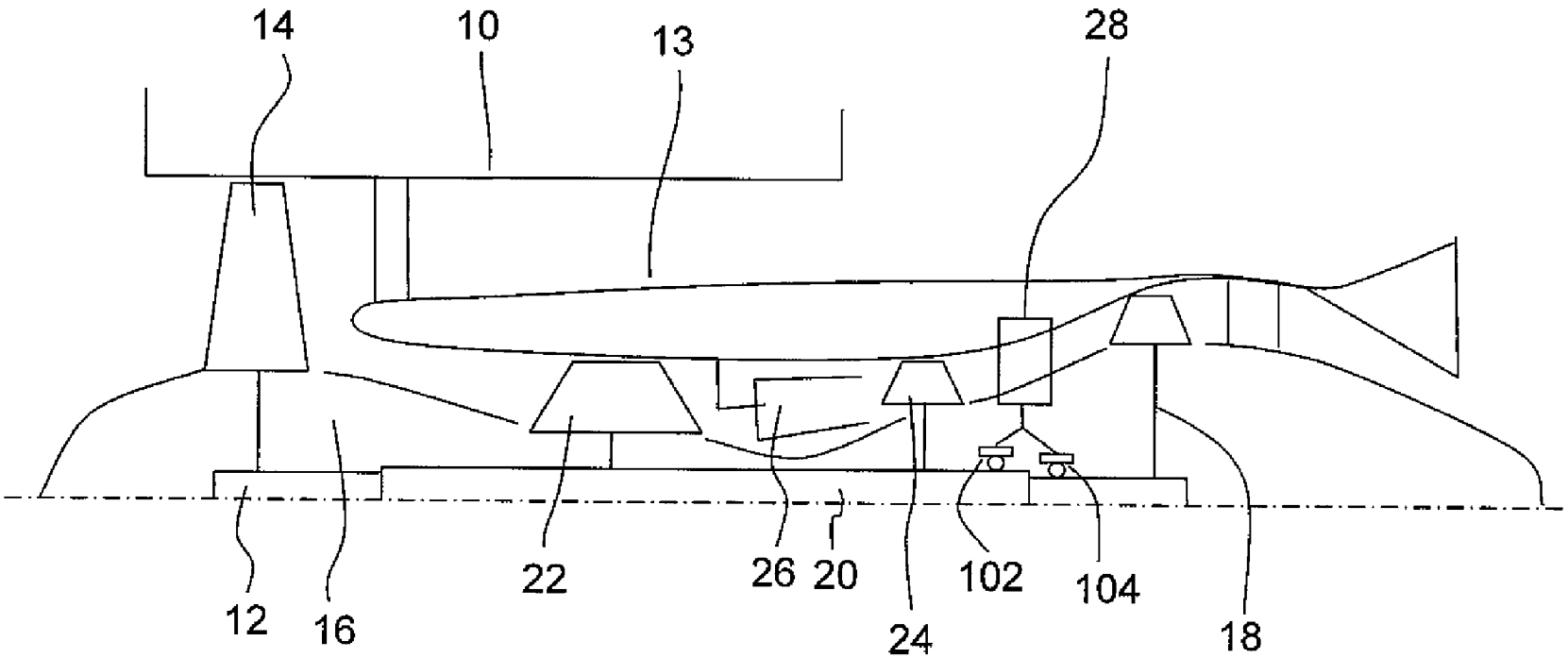
FIG. 1 is a schematic cross-sectional view of a turbofan gas turbine engine according to the present description.

Referring to FIG. 1, a turbofan gas turbine engine includes a fan case 10, a core case 13, a low pressure spool assembly which includes a fan assembly 14, a low pressure compressor assembly 16 and a low pressure turbine assembly 18 connected by a shaft 12, and a high pressure spool assembly which includes a high pressure compressor assembly 22 and a high pressure turbine assembly 24 connected by a turbine shaft 20. The core casing 13 surrounds the low and high pressure spool assemblies to define a main fluid path therethrough. In the main fluid path there is provided a combustor 26 to generate combustion gases to power the high pressure turbine assembly 24 and the low pressure turbine assembly 18. A mid turbine frame system 28 is disposed between the high pressure turbine assembly 24 and the low pressure turbine assembly 18 and supports bearings 102 and 104 around the respective shafts 20 and 12. The terms "axial", "radial" and "tangential" used for various components below, are defined with respect to the main engine axis shown but not numbered in FIG. 1.

Referring to FIGS. 1-7, the mid turbine frame (MTF) system 28 includes an annular outer case 30 which has mounting flanges (not numbered) at both ends with mounting holes therethrough (not shown), for connection to other components (not shown) which co-operate to provide the core casing 13 of the engine. The outer case 30 may thus be a part of the core casing 13. A spoke casing 32 includes an annular inner case 34 coaxially disposed within the outer case 30 and a plurality of load transfer spokes 36 (at least three spokes) radially extending between the outer case 30 and the inner case 34. The inner case 34 generally includes an annular axial wall 38 (partially shown in broken lines in FIG. 2) and truncated conical wall 33 smoothly connected through a curved annular configuration 35 to the annular axial wall 38. The spoke casing 32 supports a bearing housing 50 (schematically shown in FIG. 2), mounted thereto in a suitable fashion such as by fasteners (not numbered), which accommodates one or more main shaft bearing assemblies therein. The bearing housing 50 is connected to the spoke casing 32 and is centred within the annular outer case 30.

Figure 2:
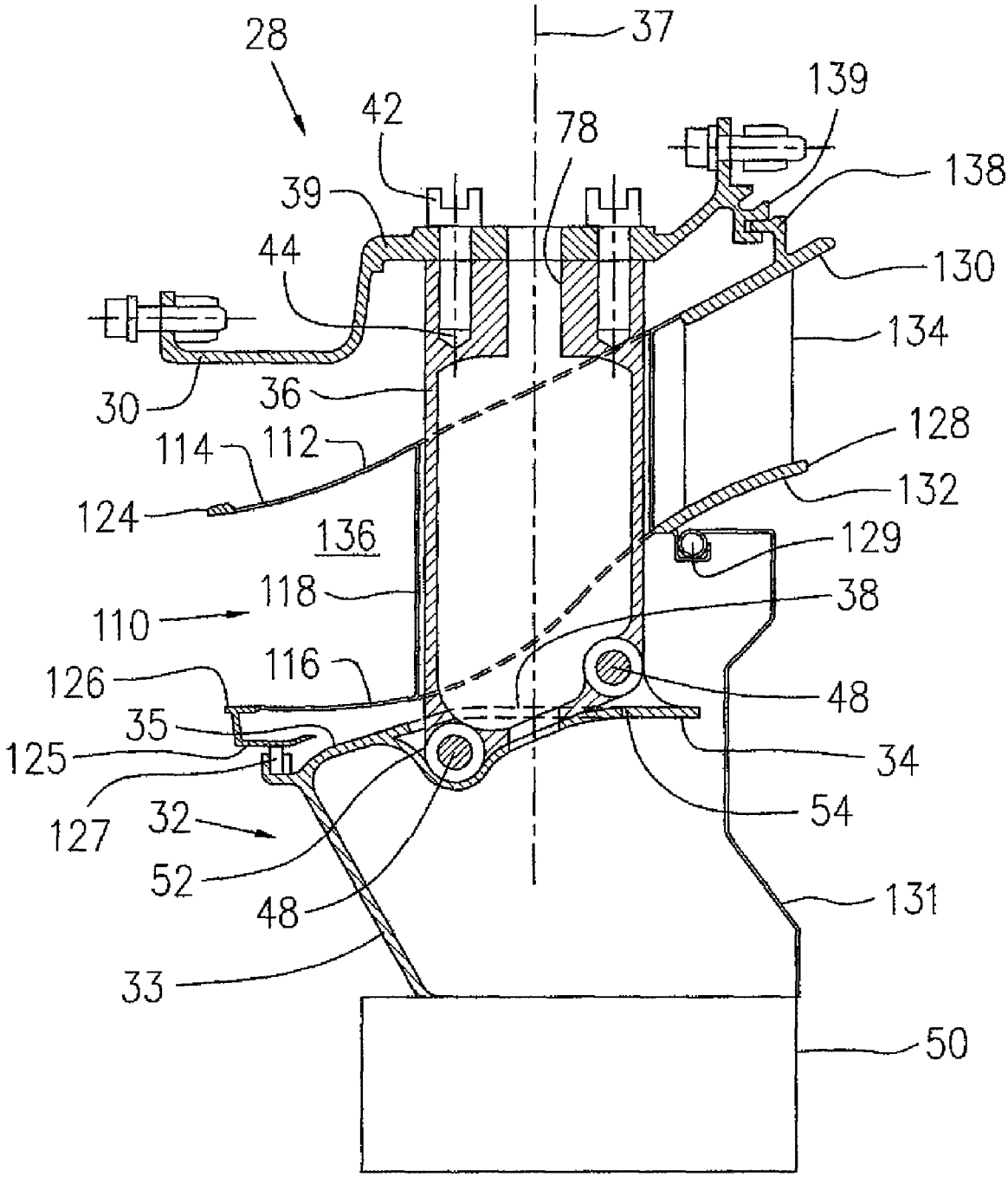
FIG. 2 is a cross-sectional view of a mid turbine frame (MTF) system having a fabricated interturbine duct (ITD)-strut and vane ring structure, according to one embodiment.
Figure 3:
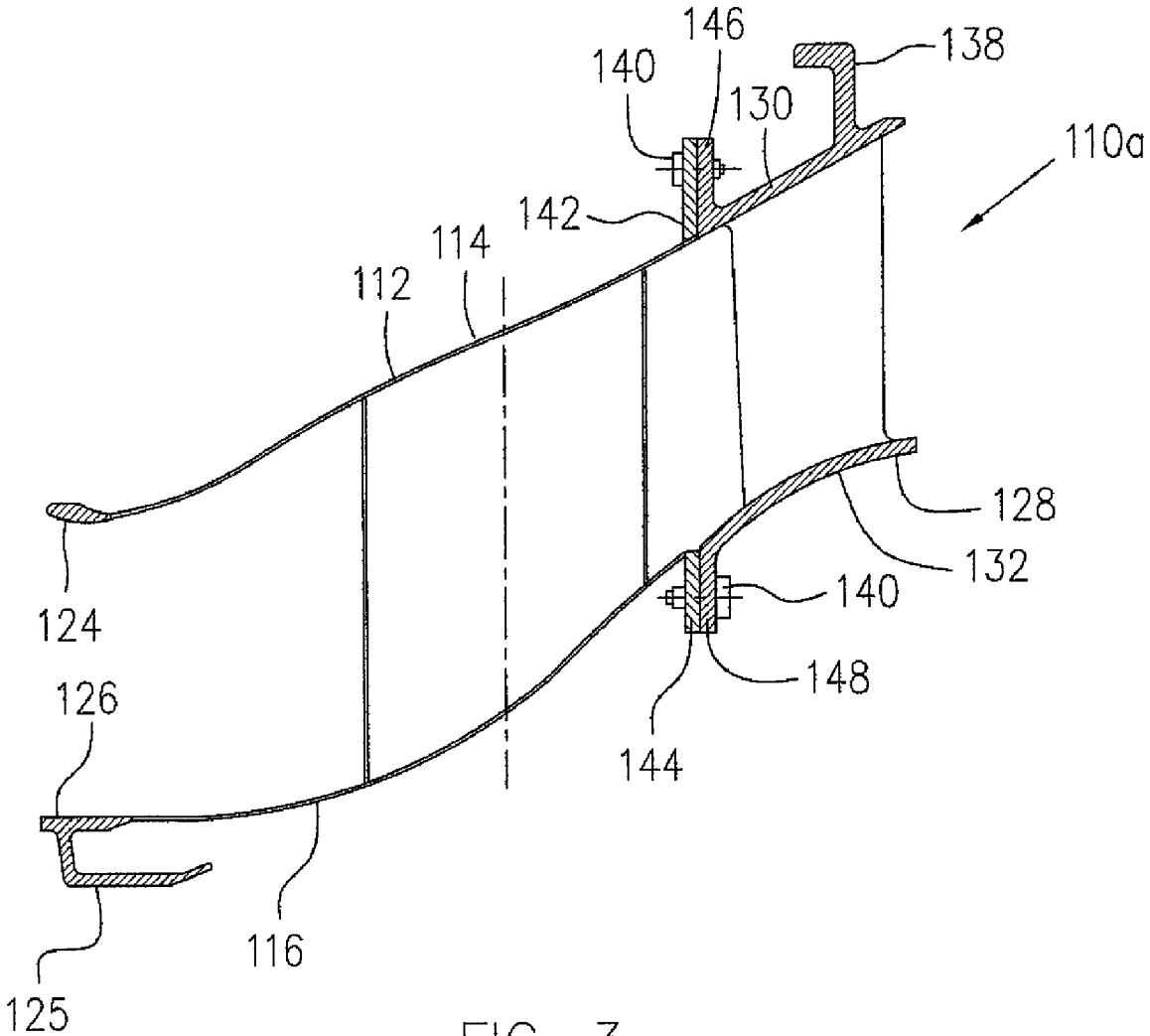
FIG. 3 is a cross-sectional view of an ITD-strut and vane structure according to another embodiment, for the MTF system of FIG. 2.
Figure 5:
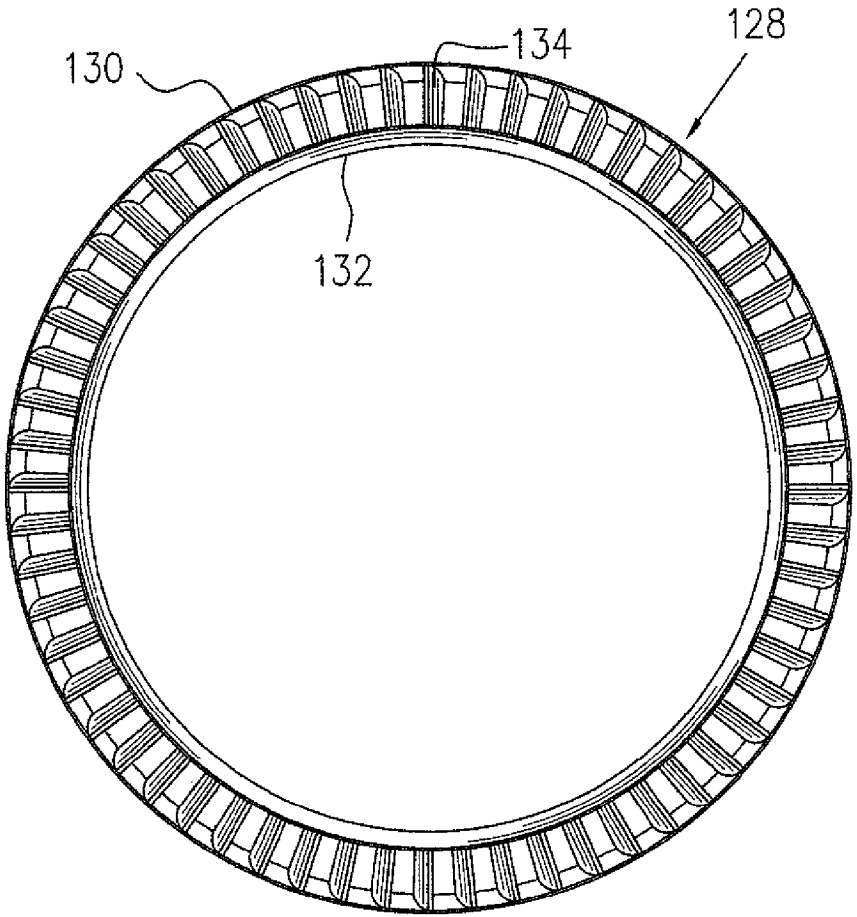
FIG. 5 is a partial perspective view of a cast vane ring configuration.
Figure 4:
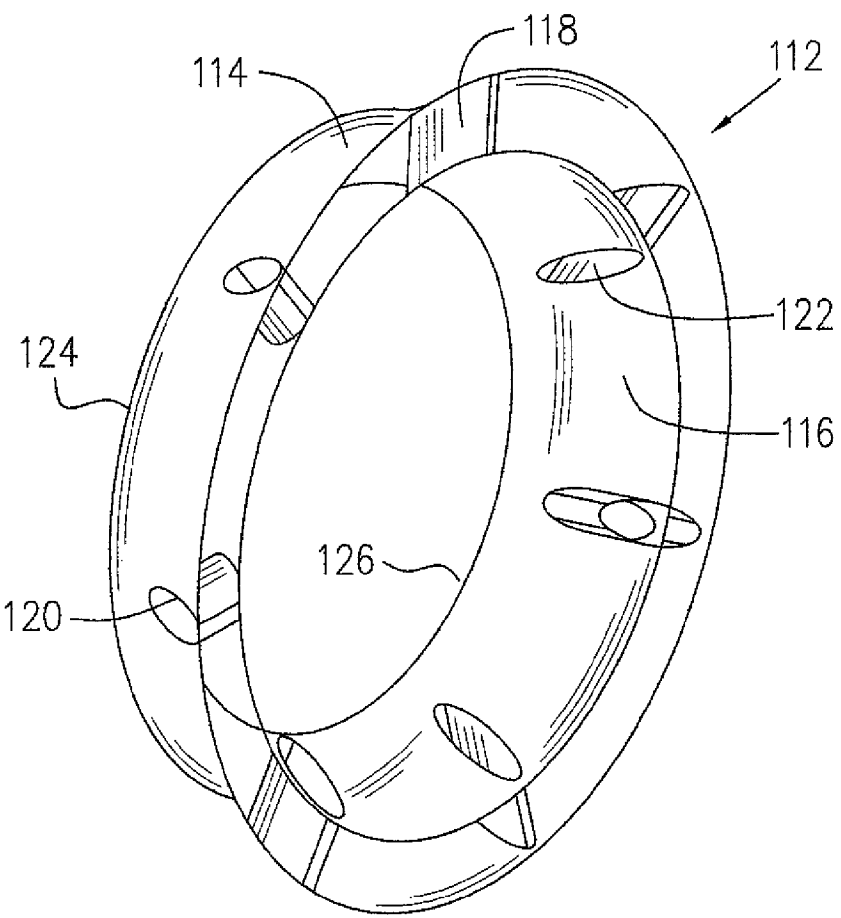
FIG. 4 is a perspective view of an interturbine duct of sheet metal with struts of sheet metal.

Referring to FIGS. 2-3, the MTF system 28 is provided with a fabricated interturbine duct-strut (ITD-strut) and vane ring structure 110 for directing combustion gases to flow through the MTF system 28. The fabricated ITD-strut and vane ring structure 110 includes an annular duct 112 mounted to a cast vane ring 128. The duct 112 has an annular outer duct wall 114 and annular inner duct wall 116, both of which are made of sheet metal in this example. Machined metal rings 124, 126 are optionally provided to an upstream end of the respective outer and inner duct walls 114, 116, integrally affixed, for example by welding or brazing. Rings 124, 126 may, for example provide an enhanced cross-section to the walls of duct 112 in the vicinity of the entry/exit, and/or may provide additional structural, aerodynamic or sealing features, such as a seal runner 125 described further below, and so on. The cast vane ring 128 which includes a pair of annular cast outer and inner rings 130 and 132 and a plurality of cast radial vanes 134. The vane ring 128 may be made as one casting or by a plurality of circumferential segments integrally joined together, for example, by welding, brazing, etc. The vane ring 128 is axially downstream of the annular duct 112, with respect to a combustion gas flow passing through the engine. The vane ring 128 is connected using any suitable approach, for example by welding to the respective outer and inner duct walls 114, 116 of the annular duct 112, to form the fabricated ITD-strut and vane ring structure 110. An annular path 136 is defined between the outer and inner duct walls 114, 116 and between the outer and inner rings 130, 132, to direct the combustion gas flow to the vanes 134.

Referring to FIGS. 2-7, the annular duct 112 further comprises a plurality of radially-extending hollow struts 118 (at least three struts) which are also made of sheet metal and are for example welded to the respective outer and inner duct walls 114 and 116. A plurality of openings 120, 122 are defined in the respective outer and inner duct walls 114, 116 and are aligned with the respective hollow struts 118 to allow the respective load transfer spokes 36 to radially extend through the hollow struts 118.

The radial vanes 134 typically each have an airfoil profile for directing the combustion gas flow to exit the annular path 136. The hollow struts 118 which structurally link the outer and inner duct walls 114, 116, may have a fairing profile to reduce pressure loss when the combustion gas flow passes thereby. Alternately, struts 118 may have an airfoil shape. Not all struts 118 must have the same shape.

The ITD-strut and vane ring structure 110 may include a retaining apparatus such as an expansion joint 138-139 (see FIG. 2) which includes a flange or circumferentially spaced apart lugs 138 affixed to the outer ring 130 for engagement with corresponding retaining slot 139 provided on the outer case 30 for supporting the ITD-strut and vane ring structure 110 within the case 30. Seals 127 and 129 may also be provided to the ITD-strut and vane ring structure 110 when installed in the MTF system 28 to avoid hot gas ingestion, control distribution of cooling air, etc.

In contrast to conventional segmented ITD-strut and vane ring structures, the ITD-strut and vane ring structure 110 according this embodiment, reduces cooling air leakage and/or hot gas ingestion through gaps between vane segments of the conventional segmented ITD structures. The fabricated ITD-strut and vane ring structure 110 may also reduce component weight relative to a cast structural design.

Figure 6:
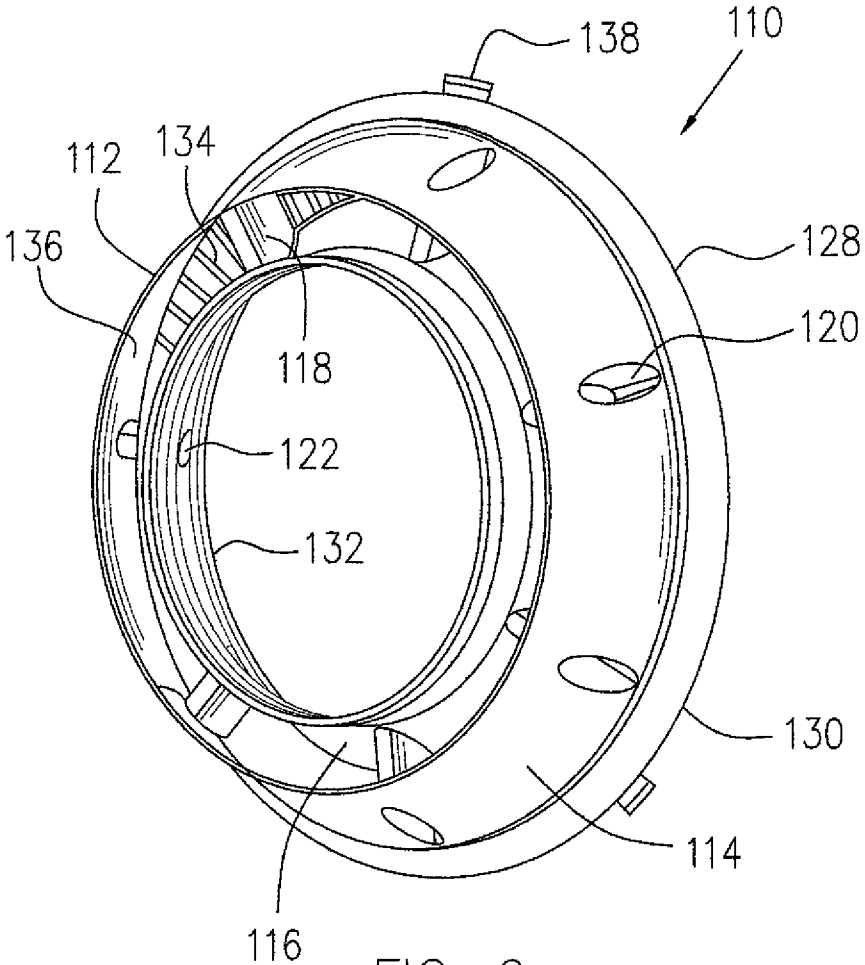
FIG. 6 is a perspective view of a one-piece fabricated ITD-strut and vane ring structure used in the MTF system of FIG. 2.

FIG. 3 illustrates a fabricated ITD-strut and vane ring structure 110*a* according to another embodiment, which is similar to the fabricated ITD-strut and vane ring structure 110 of FIGS. 2 and 6 except that the vane ring 128 and the annular duct 112 of sheet metal are connected together by fasteners 140 rather than being integrally secured together. In particular, machined metal flange rings 142, 144 are attached to the respective outer and inner duct walls 114, 116 at their downstream ends, for example by welding or brazing. Machined metal flange rings 146, 148 are provided to the upstream end of the respective outer and inner rings 130, 132. The metal flange rings 146, 148 cast with the vane ring 128 to form a one-piece cast component. Machining of the metal rings 124, 126, 142, 144, 146 and 148 may generally be conducted after these rings are attached to (if applicable) the respective annular duct 114 and the cast vane ring 128.

Referring to FIGS. 1-8, the load transfer spokes 36 are each connected at an inner end (not numbered) thereof, to the axial wall 38 of the inner case 34, for example by tangentially extending fasteners 48 (see FIGS. 2 and 8) which will be further described hereinafter. The spokes 36 may either be solid or hollow—in this example, at least some are hollow (e.g. see FIG. 2), with a central passage 78 therein. Each of the load transfer spokes 36 is connected at an outer end (not numbered) thereof, to the outer case 30, by a plurality of fasteners 42. The fasteners 42 extend radially through openings 46 (see FIG. 7) defined in the outer case 30, and into holes 44 defined in the outer end of the spoke 36 (see FIG. 2)

Figure 7:
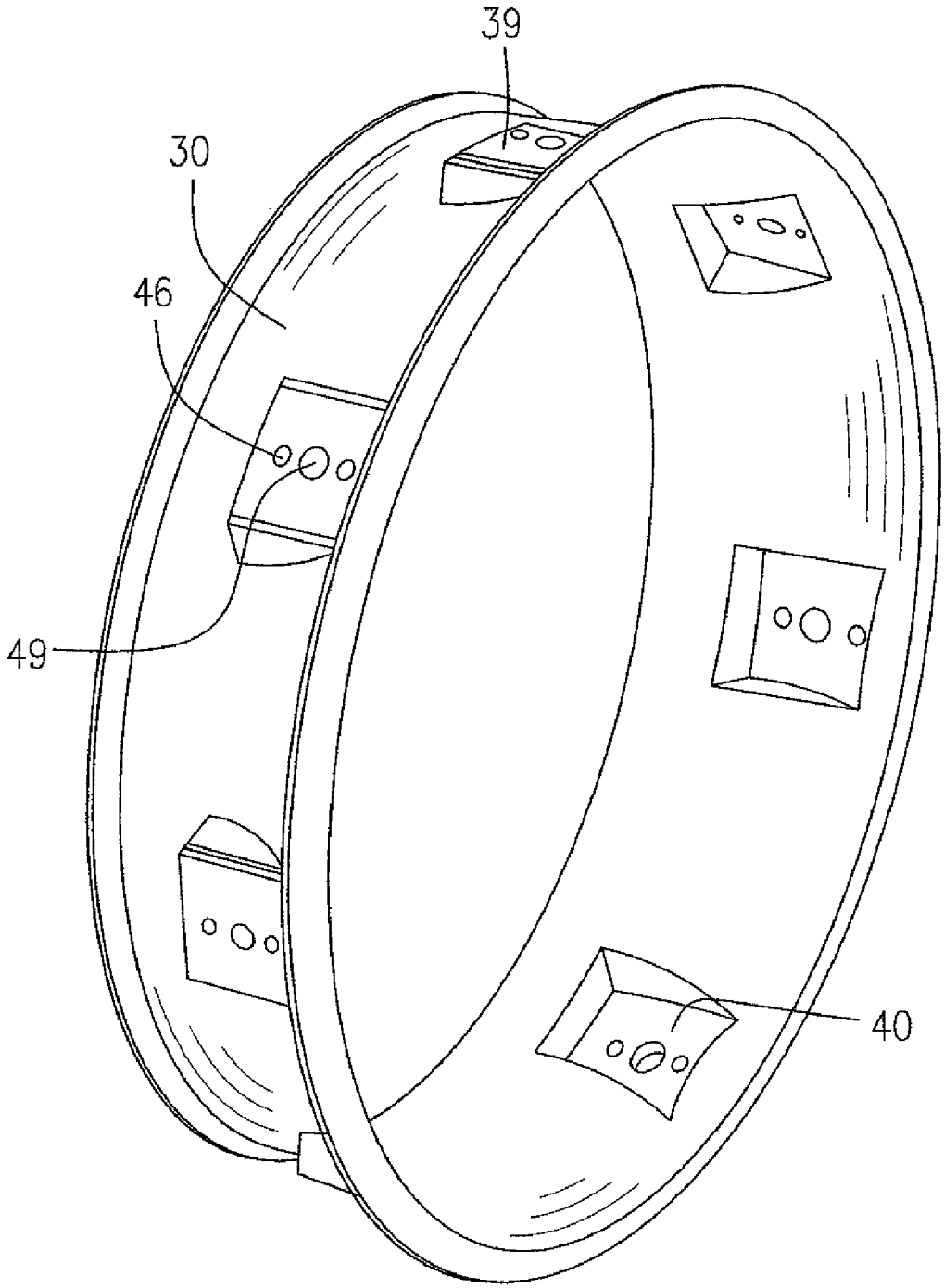
FIG. 7 is a perspective view of an outer case of the MTF system of FIG. 2.

The outer case 30 includes a plurality of support bosses 39, each being defined as a flat base substantially normal to a central axis 37 of the respective load transfer spokes 36. The support bosses 39 are formed by a plurality of respective recesses 40 defined in the outer case 30. The recesses 40 are circumferentially spaced apart one from another corresponding to the angular position of the respective load transfer spokes 36. The openings 49, as shown in FIG. 7, are provided through the bosses 39 for access to the inner cavity (not numbered) of the hollow spoke 36. The outer case 30 in this embodiment has a truncated conical configuration in which a diameter of a rear end of the outer case 30 is larger than a diameter of a front end of the outer case 30. Therefore, a depth of the boss 39/recess 40 varies, decreasing from the front end to the rear end of the outer case 30. A depth of the recesses 40 near to zero at the rear end of the outer case 30 allows axial access for the respective load transfer spokes 36 which are an integral part of the spoke casing 32. This allows the spoke casing 32 to slide axially forwardly into the respective recesses 40 when the spoke casing 32 slides into the outer case 30 from the rear end thereof during mid turbine frame assembly, which will be further described hereinafter.

In FIG. 2, the bearing housing 50 which is schematically illustrated, is detachably mounted to an annular inner end of the truncated conical wall 33 of the spoke casing 32 for accommodating and supporting one or more bearing assemblies (not shown). A load transfer link or system from the bearing housing 50 to the outer case 30 is formed by the mid turbine frame system 28. In this example, the link includes the bearing housing 50, the inner case 34 with the spokes 36 of the spoke casing 32 and the outer case 30. The fabricated ITD-strut and vane ring structure 110 is more or less structurally independent from this load transfer link and does not bear the shaft/bearing loads generated during engine operation, which facilitates providing an ITD duct and struts made of sheet metal.

The inner ends of the respective load transfer spokes 36 may be connected to the annular inner case 34 in any suitable manner. In one example (not depicted), fasteners may extend in a radial direction through the axial wall 38 of the inner case 34 and the spokes 36 to secure them to the inner case 34. In another example (not depicted), axially extending fasteners may be used to secure the inner end of the respective load transfer spokes 36 to the inner case 34. However, since the bearing case 50 is relatively small and the hollow struts 118 have an aerodynamic fairing profile, space is limited in this area which may make assembly of such arrangements problematic. Accordingly, in the embodiment of FIG. 2, the tangentially extending fasteners 48 may be used to secure the inner end of the respective load transfer spokes 36 to the inner case 34, as will now be further described.

Figure 8:
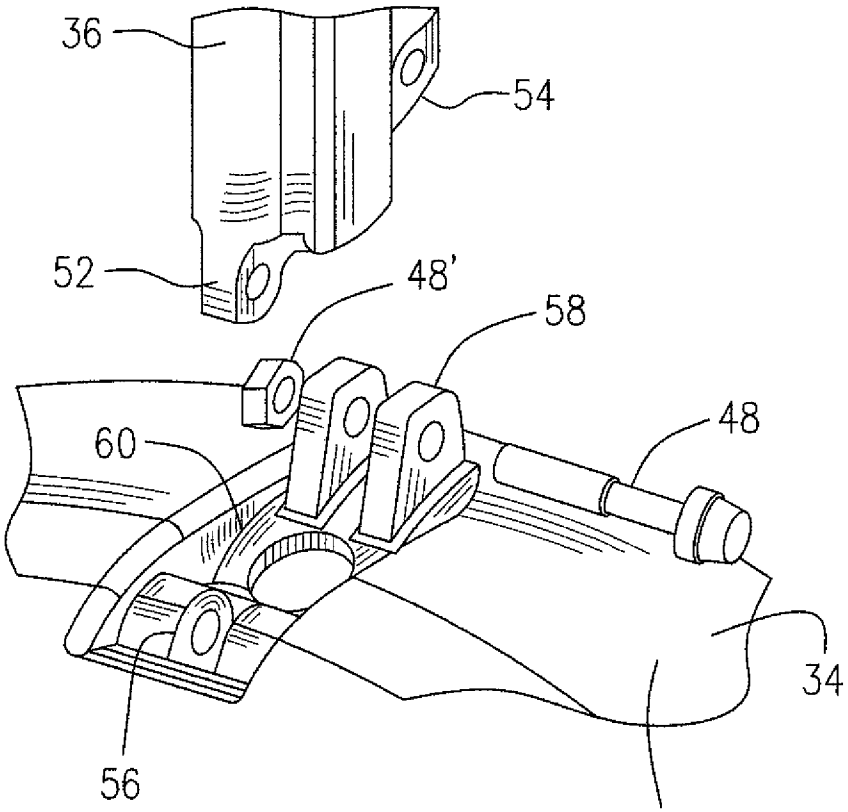
FIG. 8 is a partially exploded top perspective view of the MTF system of FIG. 2, showing a step of mounting a load transfer spoke to an inner case of a spoke casing.
Figure 9:
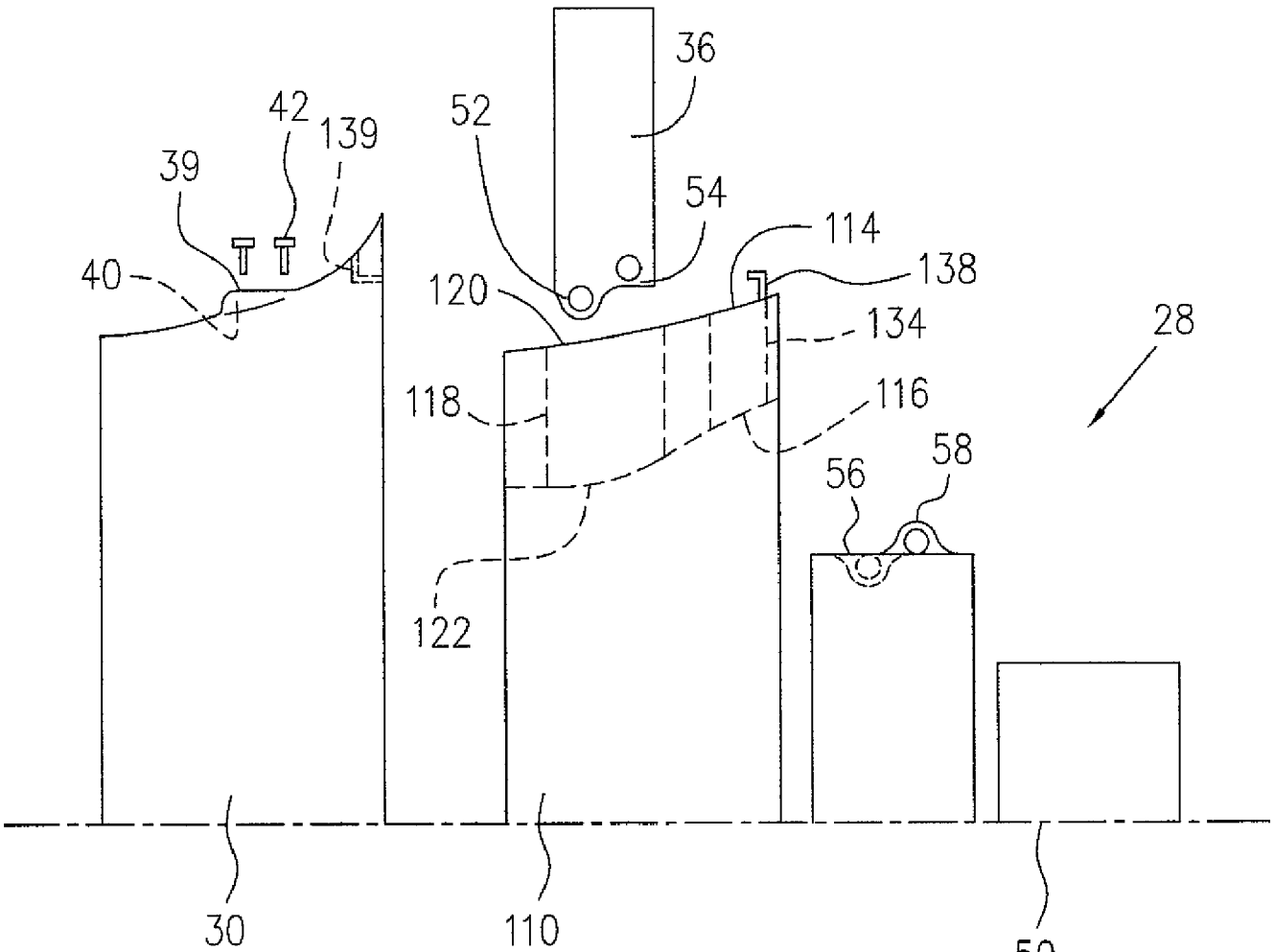
FIG. 9 is a exploded illustration schematically showing steps of an assembly procedure of the MTF system of FIG. 2.

Referring to FIGS. 2, 8 and 9, each of the load transfer spokes 36 has two connector lugs 52, 54 (see FIG. 8) at the inner end of the load transfer spokes 36, each of the connector lugs 52, 54 defining opposed flat surfaces and a mounting hole (not numbered) extending therethrough in a generally tangential direction. The connector lugs 52, 54 are axially and radially off-set from one another, as more clearly shown in FIG. 2. The inner case 34 of the spoke casing 32 includes corresponding mounting lugs 56, 58 (see FIG. 8) for respectively receiving connector lugs 52, 54 of the load transfer spokes 36. Each pair of mounting lugs 56, 58 define mounting holes (not numbered) which are aligned with the respective mounting holes of the connector lugs 52, 54 of the load transfer spokes 36 when mounted to the inner case 34, to receive the tangentially extending fasteners 48 to secure the spokes to the inner case 34. Lugs 58 may project radially outwardly of the axial wall 38 of the inner case 30, and therefore inserting the fasteners 48 is conducted outside of the axial wall 38 of the inner case 34. The lugs 56 may be defined within a recess 60 of the inner case 34, and therefore inserting the fasteners 48 to secure the connector lug 52 of the spokes 36 to the mounting lugs 56 of the inner case 34 is conducted in a recess defined within the axial wall 38 of the inner case 34. From the illustration of FIG. 2 it may be seen that both connector lugs 52 and 54 of the load transfer spokes 36 when mounted to the inner case 34, are accessible from the rear end of the spoke casing 32, either within or outside of the annular axial wall 38 of the inner case 34. Therefore, connection of the inner end of the spokes 36 to the inner case 34 can be completed from the downstream end of the inner case 34 of the spoke casing 32 during an assembly procedure. Once fasteners 48 are installed, they may be secured by any suitable manner, such as with a nut 48' (FIG. 8).

Referring to FIGS. 2 and 6-9, assembly of the MTF system 28 according to one embodiment is now described. The annular bearing housing 50 is suitably aligned with the annular inner case 34 of the spoke casing 32. The bearing housing 50 is then connected to the inner case 34 through the truncated conical wall 33. Connecting the annular bearing assembly to the inner case 34 can be conducted at any suitable time during the assembly procedure prior to the final step of connecting the outer end of the load transfer spokes 36 to the outer case 30. The front seal ring 127 is mounted to the inner case 34.

The inner case 34 is then suitably aligned with the fabricated annular ITD-strut and vane ring structure 110 (which may be configured as depicted in FIG. 2 or 3). The inner case 34 and annular bearing housing 50 is axially moved into the ITD-strut and vane ring structure 110, and further adjusted in its circumferential and axial position to ensure alignment of the mounting lugs 56, 58 on the inner case 34, with the respective openings 122 defined in the inner duct wall 116 of the ITD-strut and vane ring structure 110. Each of the load transfer spokes 36 is then radially inwardly inserted into the respective openings 120 defined in the outer duct wall 114 to pass through the hollow struts 118 until the connector lugs 52, 54 are received within the mounting lugs 56, 58 of the inner case 34. The tangentially extending fasteners 48 are then placed to secure the respective connector lugs 52, 54 of the load transfer spokes 36 to the mounting lugs 56, 58 of the inner case 34 and the fasteners secured, for example with nuts 48', thereby forming the spoke casing 32.

As described above, the connection of the connector lugs 52, 54 of the respective load transfer spokes 36 to the mounting lugs 56, 58 of the inner case can be conducted through an access from only one end (a downstream end in this embodiment) of the inner case 34.

The outer case 30 is connected to the respective load transfer spokes 36, as follows. The outer case 30 is circumferentially aligned with the spoke sub-assembly (not numbered) so that the outer ends of the load transfer spokes 36 of the spoke casing 32 (which radially extend out of the outer duct wall 114) are circumferentially aligned with the respective recesses 40 defined in the inner side of the outer case 30. When one of the outer case 30 and the sub-assembly is axially moved towards the other, the outer ends of the load transfer spokes 36 to axially slide into the respective recesses 40. Lugs 138 on the ITD-vane ring engage slots 139 on the case 30. Seal runner 125 is pressed against seal 127 at the ITD front end. Therefore, the ITD-strut and vane ring structure 110 is also supported by the inner case 34 of the spoke casing 32.

The spoke casing 32 may then be centred relative to case 30 by any suitable means, such as the radial locator approach described in applicant's co-pending application entitled "MID TURBINE FRAME FOR GAS TURBINE ENGINE" filed concurrently herewith.

The outer ends of the load transfer spokes 36 which extend radially and outwardly out of the outer duct wall 114 of the ITD-strut and vane ring structure 110 are then connected to case 30 by the radially extending fasteners 42. Rear housing 131 is then installed (see FIG. 2), mating with seal 129 on the ITD assembly. The outer case 30 is then bolted to the remainder of engine casing 13.

Disassembly of the MTF system 28 is generally the reverse of the steps described above. The disassembly procedure includes disconnecting the annular outer case 30 from the respective radial load transfer spokes 36 and removing the outer case 30 and then disconnecting the radial load transfer spokes 36 from the inner case 34 of the annular spoke casing 32. At this stage in disassembly the load transfer spokes 36 can be radially and outwardly withdrawn from the annular ITD-strut and vane ring structure 110. A step of disconnecting the annular bearing housing from the inner case 34 of the spoke casing 32 may be conducted any suitable time during the disassembly procedure.

The above description is meant to be exemplary only, and one skilled in the art will recognize that changes may be made to the embodiments described without departing from the scope of the subject matter disclosed. For example, the ITD system may be configured differently from that described and illustrated, and any suitable bearing load transfer mechanism may be used. Engines of various types other than the described turbofan bypass duct engine will also be suitable for application of the described concept. The interturbine duct and/or vanes may be made using any suitable approach, and are not limited to the sheet metal and cast arrangement described. For example, one or both may be metal injection moulded, the duct may be flow formed, or cast, etc. Still other modifications which fall within the scope of the described subject matter will be apparent to those skilled in the art, in light of a review of this disclosure, and such modifications are intended to fall within the appended claims.

The invention claimed is:

1. A method for assembly of a gas turbine engine mid turbine frame (MTF), the method comprising the steps of:

a) inserting an annular inner case within an annular interturbine duct (ITD), the ITD having at least three hollow struts radially extending between outer and inner duct walls, the struts cooperating with corresponding openings in the walls to provide radial passages through the ITD, the duct walls providing at least a portion of an engine gas path between turbine stages of the engine;

b) inserting a load transfer spoke radially into each of the ITD hollow struts until one end of the spoke extends radially inwardly of the ITD inner duct wall and the other end extends radially outwardly of the ITD outer duct wall;

c) connecting the inner end of the load transfer spokes each to the inner case;

d) inserting the inner case, ITD and spokes within an outer case so that the outer case surrounds the outer ends of the spokes, the outer case configured for mounting to the engine to provide a portion of an outer casing of the engine; and e) connecting the outer end of the load transfer spokes to the outer case.

2. The method as define in claim 1, wherein step b) is performed after step a) and step b) further comprises inserting spokes radially inwardly through the hollow struts of the duct.

3. The method as define in claim 1, further comprising mounting an annular bearing housing to the annular inner case.

4. The method as define in claim 1, further comprising mounting a vane ring to the ITD.

5. The method as defined in claim 3 wherein the mounting of the annular bearing support housing is conducted at any time prior to step e).

6. The method as defined in claim 1 wherein step e) comprises axially sliding the outer ends of the load transfer spokes into respective recesses defined in the outer case, the recesses having a bottom substantially parallel to a surface defining the outer end of the load transfer spokes.

7. The method as defined in claim 1 wherein the connection of step e) is provided by a first group of fasteners radially extending through the outer case and into the outer end of the load transfer spokes.

8. The assembly procedure as defined in claim 1 step c) comprising inserting a second group of fasteners through openings on the inner case and each load transfer spoke which are tangentially extending relative to an engine axis of rotation.

9. A method of assembly for a gas turbine engine mid turbine frame (MTF), the MTF having an annular inner case, and annular outer case, and at least three spokes extending therebetween, the method comprising the steps of:

a) providing an annular interturbine duct (ITD), the duct having inner and outer duct walls and at least three hollow struts extending therebetween, the struts and duct walls cooperating to provide radial passageways through the ITD, the ITD configured to conduct combustion gases from an turbine exit toward a downstream turbine inlet;

b) placing the inner case into the ITD and then inserting the spokes radially inwardly through the respective ITD hollow struts; and c) connecting the MTF inner case and the MTF outer case to the inner ends and outer ends, respectively, of the spokes.

10. The method as defined in claim 9, further comprising mounting an annular bearing housing to the annular inner case.

11. The method as defined in claim 9, further comprising mounting a vane ring to the ITD.

12. The method as defined in claim 9 wherein the connection of the MTF outer case to the outer ends of the spokes of step c) is provided by a first group of fasteners radially extending through the outer case and into the outer ends, respectively, of the spokes.

13. The method as defined in claim 9 wherein the connection of the MTF inner case to the inner ends of the spokes of step c), is provided by a second group of fasteners through openings on the inner case and each spoke which are tangentially extending relative to an engine axis of rotation.

14. The method as defined in claim 13 wherein each of the spokes comprises at least one connector lug at the inner end, the lug defining the tangentially extending opening between opposed flat surfaces of the lug.

15. A method of disassembly for a gas turbine engine mid turbine frame (MTF), the MTF having annular inner and outer cases with radial spokes extending therebetween, the MTF further defining therethrough an annular interturbine duct (ITD) between the inner and outer MTF cases, the ITD having an inner and outer duct walls with hollow struts extending between the duct walls, the spokes disposed inside the hollow struts, the method comprising the steps of:

a) removing a plurality of fasteners to disconnect the annular outer case of the MTF from a plurality of radial load transfer spokes of a spoke casing, and then removing the spoke casing from the annular outer case;

b) removing a plurality of fasteners to disconnect the radial load transfer spokes from an inner case of the spoke casing;

c) radially outwardly withdrawing the load transfer spokes from the annular ITD; and then d) removing the inner case of the spoke casing from the ITD.

16. The method as defined in claim 15 further comprising a step of removing an bearing housing from the inner case and wherein said step is conducted any time during the disassembly procedure.

17. The method as defined in claim 15 wherein the spoke casing is removed from the outer case by sliding the spoke casing axially rearwardly relative to the outer case.

18. The method as defined in claim 15 further comprising demounting a vane ring from the ITD.

* * * * *